US005894288A

United States Patent [19]

Lee et al.

[11] Patent Number: 5,894,288

[45] Date of Patent: Apr. 13, 1999

[54] WIDEBAND END-FIRE ARRAY

[75] Inventors: Jar J. Lee, Irvine; Stan W. Livingston, Fullerton, both of Calif.

[73] Assignee: Raytheon Company, Lexington, Mass.

[21] Appl. No.: 08/907,522

[22] Filed: Aug. 8, 1997

[51] Int. Cl.[6] ..... H01Q 13/10

[52] U.S. Cl. ..... 343/770; 343/767

[58] Field of Search ..... 343/767, 770, 343/795, 820, 821, 853; H01Q 13/10

[56] References Cited

U.S. PATENT DOCUMENTS

| | | | |
|---|---|---|---|
| 5,227,808 | 7/1993 | Davis | 343/767 |
| 5,428,364 | 6/1995 | Lee et al. | 343/767 |
| 5,461,392 | 10/1995 | Mott et al. | 343/767 |
| 5,557,291 | 9/1996 | Chu et al. | 343/725 |
| 5,786,792 | 7/1998 | Bellus et al. | 343/770 |

*Primary Examiner*—Don Wong
*Assistant Examiner*—Tan Ho
*Attorney, Agent, or Firm*—Leonard A. Alkov; Glenn H. Lenzen, Jr.

[57] ABSTRACT

A wideband end-fire array including columns or sub-arrays of flared notch radiating elements spaced along an end-fire axis and fed by a true-time-delay corporate feed network. The feed network includes a corporate feed manifold and a plurality of cables connected between a respective manifold port and a balun comprising a corresponding radiating element. The plurality of cables have corresponding electrical line lengths adapted to provide progressive time delays to signals carried between the radiating elements and the feed manifold so as to equalize the time delays due to spacing of the elements along the axis.

13 Claims, 5 Drawing Sheets

FIG. 1
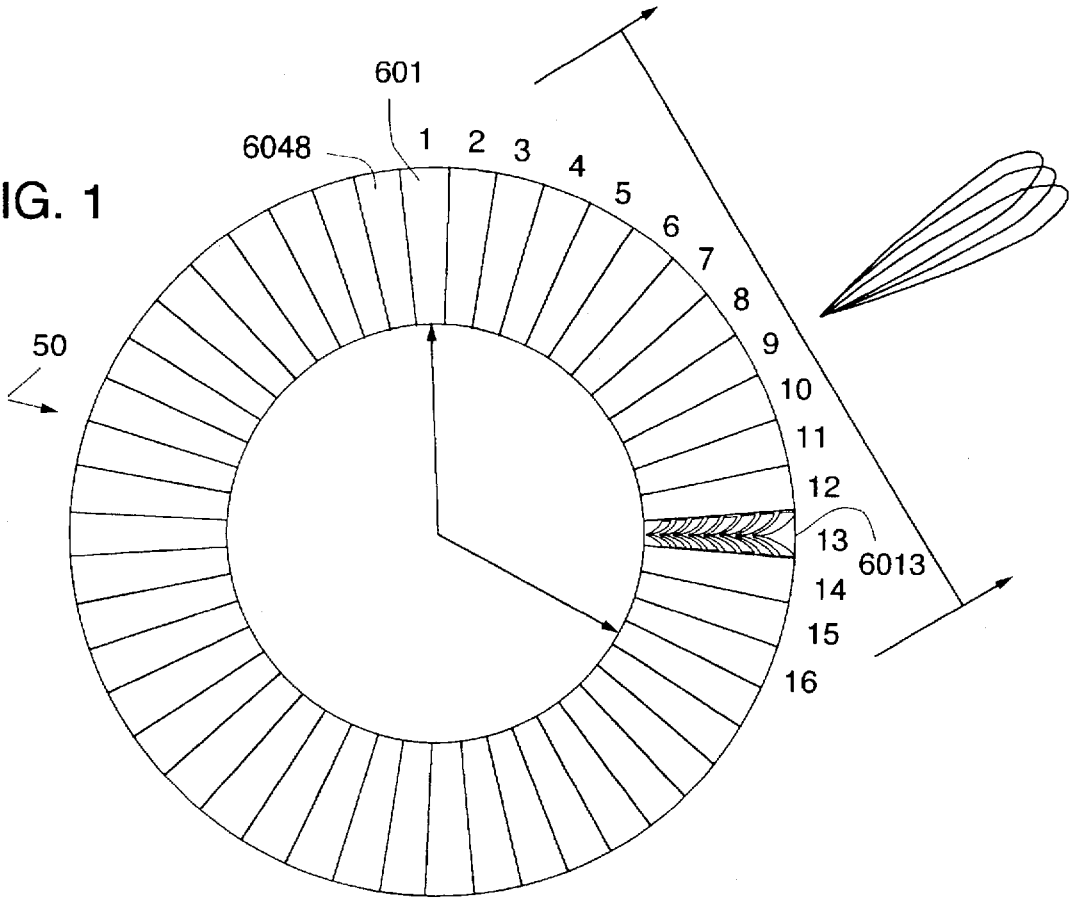
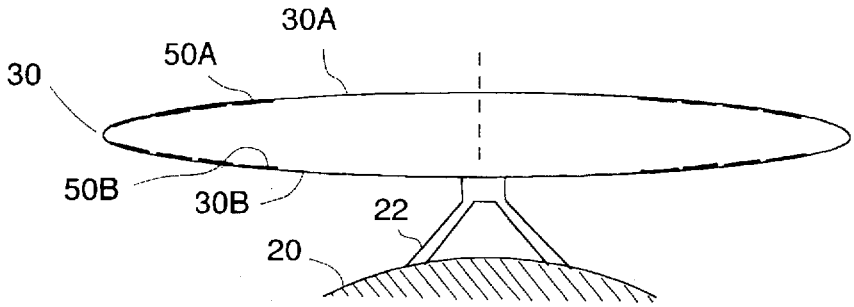
FIG. 2

WIDEBAND END-FIRE ARRAY

CROSS-REFERENCE TO RELATED APPLICATION

This application is related to commonly assigned, co-pending application Ser. No. 08/907,569, filed Aug. 8, 1997, entitled WIDEBAND CYLINDRICAL UHF ARRAY, Attorney Docket Number PD-960448, the entire contents of which are incorporated herein by this reference.

TECHNICAL FIELD OF THE INVENTION

This invention relates to antenna arrays, and more particularly to a wideband end-fire array employing a true-time-delay corporate feed.

BACKGROUND OF THE INVENTION

Conventional end-fire Yagi arrays using dipoles and parasitic elements fed by a series feed are relatively narrow-banded (typically less than 15%), because the radiating elements and the series feed have limited band-widths. This drawback becomes even more pronounced when the end-fire array is longer than about 8 elements.

It would therefore represent an advance in the art to provide an end-fire array having a wide bandwidth.

SUMMARY OF THE INVENTION

The invention alleviates the limited bandwidth problem by using wide band radiating elements whose form factor is compatible with the end-fire array configuration, and a true-time-delay corporate feed. The end-fire array in accordance with the invention may be used to replace conventional Yagi antennas for many applications such as airborne surveillance systems, wideband TV and point to point HF communications.

According to one aspect of the invention, a wideband end-fire array of radiating elements includes a plurality of planar radiating elements arranged end-to-end along a common end-fire axis, each element comprising a flared notch radiating element. The array further includes a true-time-delay corporate feed network connected to the radiating elements.

The radiating elements are spaced along the axis by one-quarter wavelength at a center frequency of operation for the array, and the array provides an end-fire beam in only one direction along the axis. The radiating element includes a pair of flared dipole wings.

The feed network includes a plurality of transmission lines of unequal length, for providing true time delay to signals from the different elements of the end-fire array so as to equalize the time delays and maximize the combined signal from the array elements.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a simplified top view of a conformal cylindrical array with a plurality of columns of end-fire elements in accordance with this invention.

FIG. 2 is a side cross-sectional view of the array of FIG. 1, mounted on an aircraft fuselage.

DETAILED DESCRIPTION OF THE PREFERRED EMBODIMENT

Figure 3:
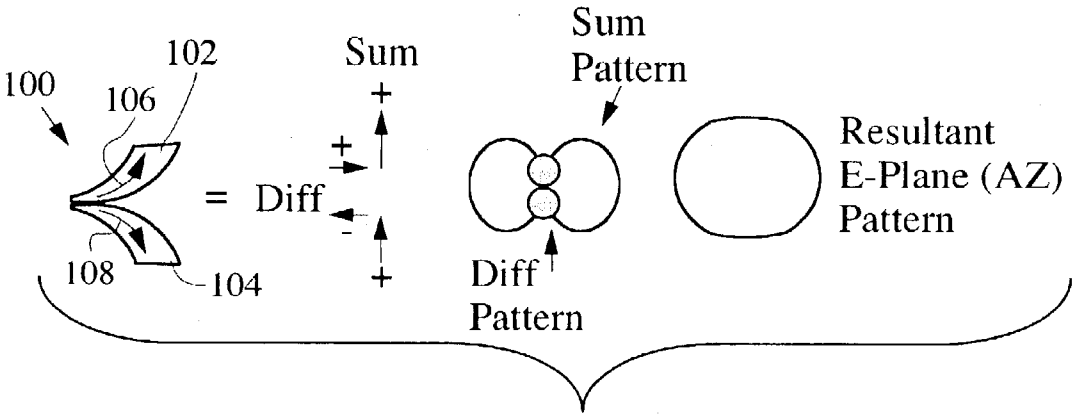
FIG. 3 is a diagrammatic view of one radiating element, illustrative of its operation and radiation patterns.

An exemplary embodiment of the invention is illustrated in FIGS. 1–7, and is adapted for use in an airborne application, attached to the fuselage roof of an aircraft. As shown in a simplified top view in FIG. 1, the array 50 is a conformal cylindrical array with a plurality (in this exemplary embodiment 48) of columns 601–648 of end-fire elements. The array is controlled by a fast-switching (on the order of 10 micro-seconds) beamforming network capable of 360 degree scan in the azimuth plane, as described more fully in the above referenced application entitled "Wideband Cylindrical UHF array." The beamforming system has 48 beam positions, wherein only 16 of the 48 columns are excited at any given time. FIG. 1 illustrates exemplary beams formed by excitation of columns 1–16.

An exemplary application for the array 50 is in a sensor system mounted on an aircraft fuselage, as illustrated in FIG. 2. Here a radome 30 is mounted on the roof of aircraft fuselage 20 by support fixture 22. The beam is electronically scanned, eliminating the need for a rotary joint. To reduce the elevation (EL) beamwidth and maximize the end-fire gain, two decks 50A, 50B of elements are used, adjacent and conformal to the upper and lower surfaces 32, 34 of the radome 30 in a double-deck arrangement. The end-fire elements may alternatively be embedded in the skin of the saucer-shape radome 30. Essentially, each deck has a complete 48-column array as shown in FIG. 1, with respective corresponding columns of each deck array in vertical alignment. To reduce the elevation beamwidth, the corresponding columns of the two decks of arrays should be separated by a distance in the range of one half wavelength to one wavelength at the center of the operating band. The signals from the two arrays 50A and 50B are combined to form a composite beam with increased gain.

The radiating element for the array is a variation of a flared notch design, and is more fully described in commonly assigned U.S. Pat. No. 5,428,364, the entire contents of which are incorporated herein by this reference. An exemplary one of the radiating elements is shown in FIG. 3. The radiating element 100 consists of a pair of flared dipole wings 102, 104 which form a balanced circuit, and a balanced feed section (shown in FIG. 7), such as a twin lead transmission line section. This radiating element is a low cost element that can be machined out of a thin metal plate with an about 0.25" gap G (FIG. 7) at the input for high power applications. This element is suitable for multi-octave wideband applications, because it behaves basically as a fat dipole at the low end of the frequency band and as an end-fire radiator at the high end of the frequency band, with a launching section embodied in a transmission line structure. This TEM feed is a departure from a conventional design using a band limited quarter-wave stick shaped feed.

For an exemplary embodiment, the input impedance of the element 100 was conveniently chosen to be about 300 ohm, so that commercially available TV baluns could be used to reduce cost. In practical, high volume applications, the impedance can be lowered to 200 ohm by slightly reducing the gap G, so that it can be matched to a 50 ohm line using a standard 4:1 transformer and balun. The 12 inch by 10 inch element for this exemplary embodiment was matched over a 3:1 range from 300 to 900 MHz with a VSWR better than 2:1.

Figure 4A:
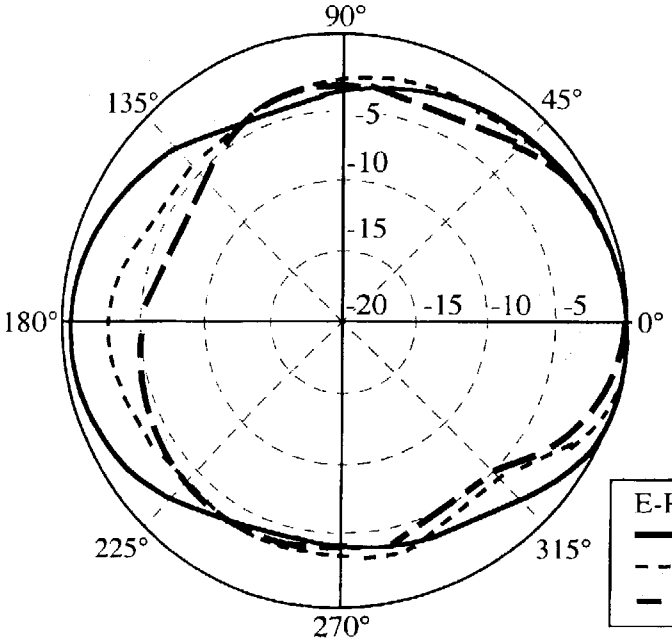
FIGS. 4A and 4B show illustrative E- and H-plane patterns of an exemplary form of the radiating element from 400 to 500 MHz.
Figure 4B:
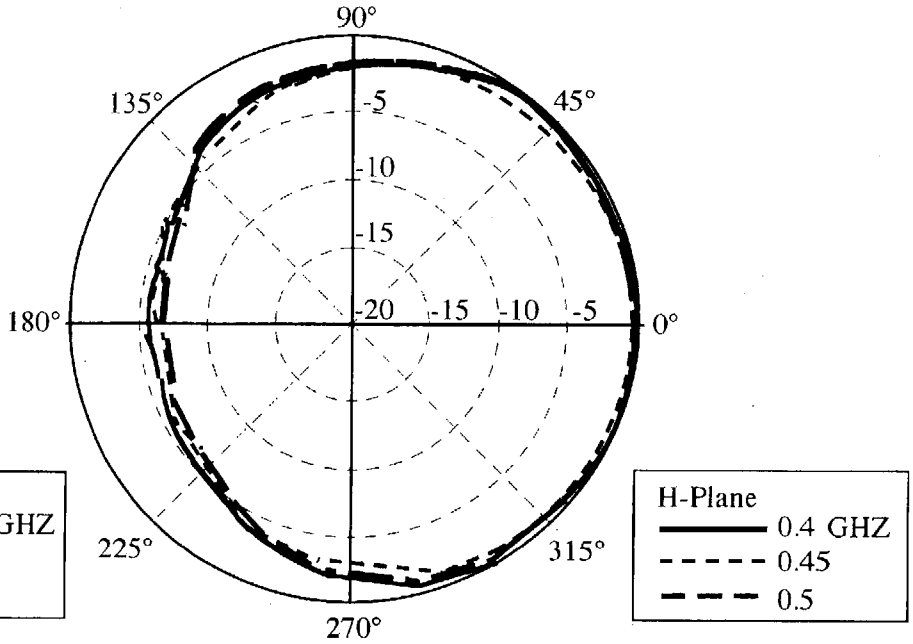

The measured E- and H-plane patterns of the element 100 from 400 to 500 MHz are shown in FIGS. 4A and 4B. The average front to back ratio is about 5 dB. Note that the E-plane pattern is different from the normal pattern of a thin dipole. As shown in FIG. 3, essentially the surface current on the flared dipole consists of two components represented by arrows 106, 108, one being the dominant sum term and the other a small difference term. The combining effect is an oval shape pattern as shown in FIGS. 4A and 4B. Compared with the conventional thin dipole, this element offers a broader E-plane pattern, a desirable feature for array applications for wide scan.

Figure 5:
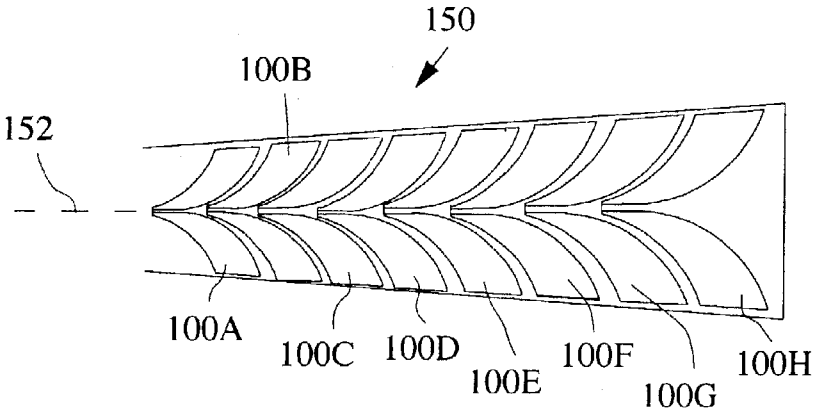
FIG. 5 is a top view diagrammatic view of an exemplary embodiment of a sub-array or column, comprising a plurality of the radiating elements of FIG. 3.

Using the wideband elements 100, an eight-element end-fire subarray or column for the antenna is provided. A top diagrammatic view of an exemplary embodiment of the sub-array 150 comprising elements 100A–100H, is shown in FIG. 5. The elements are positioned end-to-end on end-fire axis 152. The element spacing along the axis is 6.5 inches (16.5 cm), equal to one quarter wave length at 450 MHz. The spacing was chosen to produce an end-fire beam in only one direction as opposed to a bidirectional case with a half wave length spacing. The columns are tapered in size from a larger width at the outer periphery of the array to a smaller width at the interior of the channel. The tapering enables the columns to be fitted into a circular array configuration, with the columns extending radially outward. The tapering is not believed to have a significant effect on the electrical properties of the array. The sub-array is wideband, and tolerant to size variations.

Figure 6B:
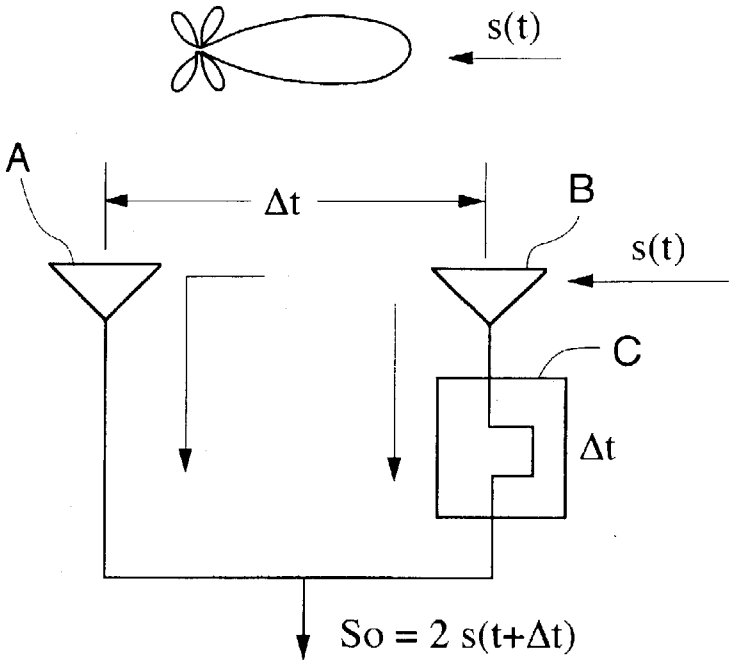
FIG. 6 illustrates the end-fire array and how the back lobe can be eliminated with proper phasing.
Figure 6A:
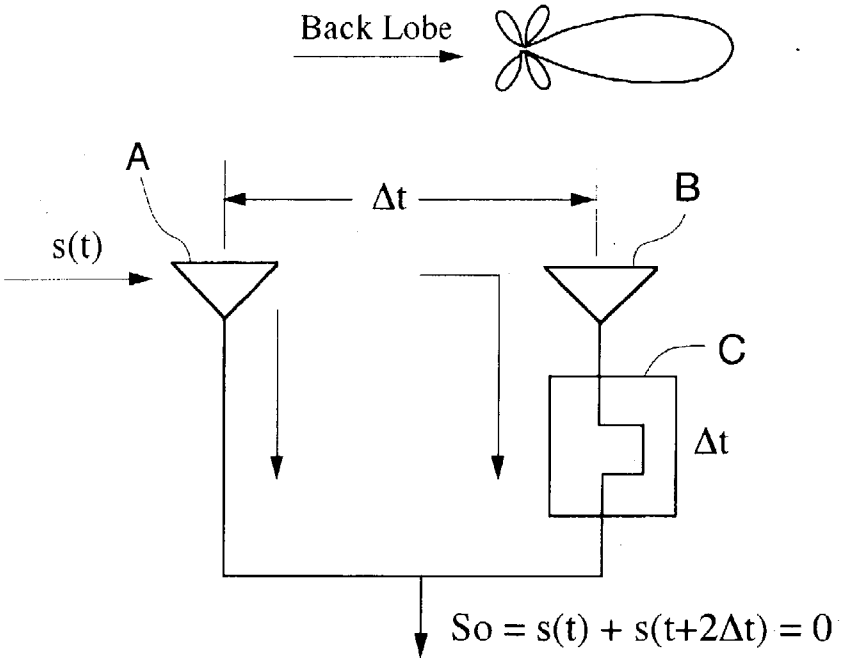

FIGS. 6A and 6B illustrates the end-fire array and how the back lobe can be eliminated with proper phasing. The radiating elements A and B are separated by an electrical length equal to one quarter wavelength at band center, producing a time differential $\Delta t$ in the time of arrival of a signal incident on the array in an end-fire direction. The output of element B is passed through a quarter wave delay line C, which produces the same time delay $\Delta t$. With a signal s(t) incident from the left as shown in FIG. 6A, the combined signal $S_O=s(t)+s(t+2\Delta t)=0$, since the signal $s(t+2\Delta t)$ will be 180 degrees out of phase with s(t). Assume the direction of incidence of s(t) in FIG. 6A to be from the backside of the subarray of A and B, and thus the back lobe is canceled when the frequency of the signal is at the design frequency which produces the one-quarter wavelength array spacing. Now consider the operation shown in FIG. 6B, the end-fire direction. $S_O=2s(t+\Delta t)$, with the delay line providing a maximum output from the two elements in this direction for any signal frequency in the operating band.

Note that a quarter wave end-fire array has an effective aperture equal to $(2L)/(N^{1/2})$ in its cross section, where L is the array length and N the number of elements. Based on this, the 3 dB beamwidth in both E- and H-plane as a function of frequency can be estimated by $$BW_{3dB} \sim 35\lambda N^{1/2}/L \text{ (deg)}$$

This effective aperture will have a phase error of less than the phase errors allowed ($\lambda/16$) associated with the wave fronts. When an even number of elements is used in the N element subarray, the back lobe will vanish because every other element cancel out the contribution from each other in the backward direction independent of the element pattern, as illustrated in FIG. 6A. If an odd number of elements is used in the array, the amplitude of the remnant back lobe is only 1/N of the main lobe amplitude.

Figure 7:
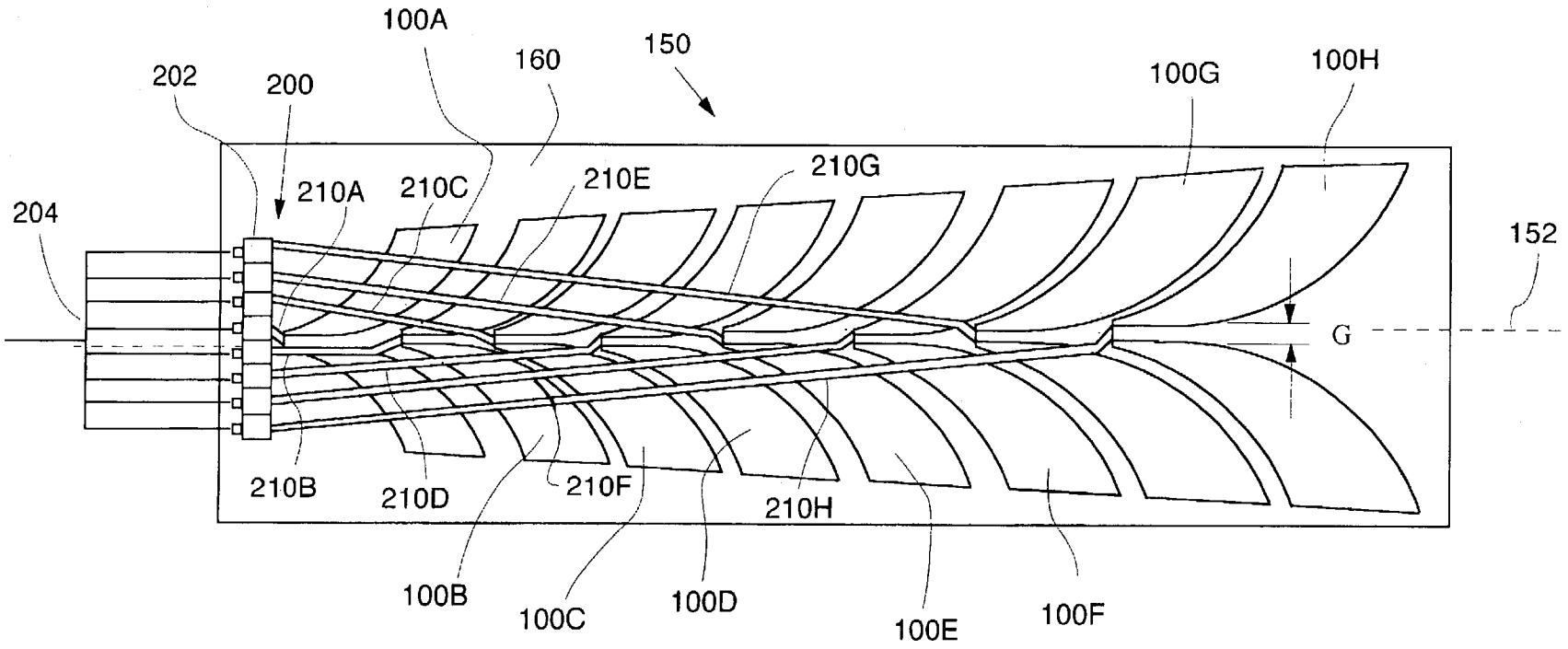
FIG. 7 illustrates the end-fire subarray and its true-time-delay feed network.

The end-fire subarray is well behaved from 300 to 800 MHz because the elements support wideband and a true-time-delay feed network is used. The end-fire subarray 150 is fed by a true-time-delay cable assembly 200 as shown in FIG. 7. The array elements 100A–100H and the feed assembly 200 are attached to the opposite sides of a dielectric honeycomb structure 160, so that the cables lie essentially in a plane. The radiating elements are formed, e.g. by a deposition process or a photolithographic process, on the top surface and fed by the twin lead transmission line feed assembly 200 from the bottom surface. Cables 210A–210H are respectively connected between terminals of a feed through mounting block 202 and the balun for a corresponding one of the elements 100A–100H. Corresponding terminals of the block 202 are connected to terminals of a corporate feed manifold 204, acts as a signal divider/combiner, i.e. on transmit to divide one input feed signal into N equal signals, and on receive to combine the signals received at the N radiating elements of the array. The unequal lengths of the cables 210A–210H are determined by the desired time delays between elements. The elements are spaced physically apart by $\lambda/4$ (at band center) along the subarray axis 152, resulting in progressive time delays in the time of arrival/transmission of signals propagating along the axis 152. The length of the cables are provided to provide progressive time delays in increments of $\lambda/4$ so as to equalize these time delays, and thereby maximize the combined/transmitted signal. For signals incident from the right along axis 152, i.e. the main end-fire direction, the incident energy arrives first at radiating element 100H, then a $\Delta t$ later at element 100G, then $2\Delta t$ later at element 100F, and so on. To equalize these delays due to spacing of the elements along the end-fire axis, the cables 210A–210H have unequal lengths which are selected so that the signals at the mounting block 202 will arrive in time synchronism. Thus, for this exemplary array having 8 elements spaced apart by a distance producing signal propagation delays of $\Delta t$, 210A will have some minimal electrical length L needed to connect to the block 202, producing some incremental time delay. In one exemplary application, the cables are twin lead transmission lines, which are balanced transmission lines, but other types of cables such as coaxial lines could be used with appropriate transforming elements known to those skilled in the art. Cables 210B–210H will then have progressively longer lengths equivalent to the length L plus a length selected to produce the desired delay to equalize the propagation delays due to the physical spacing of the elements. Cable 210B will have an effective length of L plus a length L1 which produces a time delay $\Delta t$. Cable 210C will have an effective length of L plus a length L2 which produces a time delay $2\lambda t$, cable 210D will have a length of L plus a length L3 which produces a time delay $3\lambda t$, and so on. Those skilled in the art can determine the appropriate cable lengths, taking into account dielectric loading effects so that the differential time delays through the cables are referenced to the free space propagation delays between elements.

While an exemplary array of 8 radiating elements has been described in detail, in general an N element array can be utilized, with N higher or lower than 8.

The advantages of the N channel corporate feed 204 as compared with a series feed are the true time delays for wideband operation, individual phase and amplitude control of each element for signal processing and 1/N the power in each branch compared with a main trunk to reduce arcing. Other advantages of a planar feed integrated with the radiating element include low cost, mechanical reliability, and light weight.

There has been described a wideband end-fire array capable of more than an octave bandwidth. The exemplary embodiment is designed for operation for a 300 MHz to 800 MHz applications, but the design can be scaled to other frequency bands. The array is particularly well suited to systems where compact uni-directional high gain antennas are needed.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A wideband end-fire array of radiating elements, comprising:

a plurality of radiating elements arranged end-to-end along a common end-fire axis and spaced apart along the axis by a separation distance, each element comprising a flared notch radiating element; and a true-time-delay corporate feed network connected to the radiating elements, wherein time delay differences in contributions by the individual radiating elements to a composite array signal due to the separation of the elements along the axis are equalized by the corporate feed network.

2. The array of claim 1 wherein the radiating elements are spaced along the axis by one-quarter wavelength at a center frequency of operation for the array, and the array provides an end-fire beam in only one direction along the axis.

3. The array of claim 1 wherein the radiating element includes a pair of flared dipole wings.

4. The array of claim 1 wherein said array is adapted for operation over a frequency band from 300 MHz to 800 MHz.

5. The array of claim 1 wherein said corporate feed network comprises a corporate feed manifold and a plurality of cables of unequal length, said cables connected between a respective manifold port and a balun comprising a corresponding radiating element.

6. The array of claim 5 further comprising a dielectric support structure having first and second opposed surfaces, and wherein said plurality of radiating elements are formed on said first surface, and wherein said cables lie along said second surface.

7. The array of claim 5 wherein the radiating elements are spaced along the axis by one-quarter wavelength at a center frequency of operation for the array, and wherein said plurality of cables have corresponding electrical line lengths adapted to provide progressive time delays to signals carried between radiating elements and the feed manifold.

8. The array of claim 5 wherein said cables include twin-lead cables.

9. The array of claim 5 wherein said cables include coaxial cables.

10. A wideband end-fire array of radiating elements for operation over a frequency band of operation, comprising:

a plurality of radiating elements arranged end-to-end along a common end-fire axis, each element comprising a flared notch radiating element, the radiating elements spaced by one-quarter wavelength at an operating frequency within the band of operation; and a true-time-delay corporate feed network connected to the radiating elements, said corporate feed network comprises a corporate feed manifold and a plurality of cables, said cables connected between a respective manifold port and a balun comprising a corresponding radiating element, and wherein said plurality of cables have corresponding electrical line lengths adapted to provide progressive time delays to signals carried between said radiating elements and the feed manifold to equalize signal propagation delays along the array axis.

11. The array of claim 10 wherein the radiating element includes a pair of flared dipole wings.

12. The array of claim 10 wherein said array is adapted for operation over a frequency band from 300 MHz to 800 MHz.

13. The array of claim 10 further comprising a dielectric support structure having first and second opposed surfaces, and wherein said plurality of radiating elements are formed on said first surface, and wherein said cables lie along said second surface.

* * * * *

UNITED STATES PATENT AND TRADEMARK OFFICE

CERTIFICATE OF CORRECTION

PATENT NO : 5,894,288

DATED : April 13, 1999

INVENTOR(S) : Jar J. Lee and Stan W. Livingston

It is certified that error appears in the above-identified patent and that said Letters Patent is hereby corrected as shown below:

At column1, line 18, insert the following as the first paragraph after the heading BACKGROUND OF THE INVENTION:

-- This invention was made with Government support under Contract Number N68335-96-C-0106 awarded by the Department of the Navy. The Government has certain rights in this invention. --

Signed and Sealed this

Twenty-fifth Day of January, 2000

*Attest:*

*Attesting Officer*

*Acting Commissioner of Patents and Trademarks*